United States Patent [19]

Bergman

[11] 4,260,076

[45] Apr. 7, 1981

[54] POWERED DISPENSER FOR CAULKING CARTRIDGE CONTENTS

[75] Inventor: Carl P. Bergman, Pompano Beach, Fla.

[73] Assignee: Whirlco, Inc., Pompano Beach, Fla.

[21] Appl. No.: 75,241

[22] Filed: Sep. 14, 1979

[51] Int. Cl.[3] ..... B67D 5/22; B67D 5/42

[52] U.S. Cl. ..... 222/46; 222/50; 222/333; 222/327; 222/390

[58] Field of Search ..... 222/390, 46, 47, 48, 222/49, 50, 333, 325, 326, 327

[56] References Cited

U.S. PATENT DOCUMENTS

| | | | |
|---|---|---|---|
| 207,841 | 9/1878 | Bates | 222/46 |
| 3,208,638 | 9/1965 | Frenzel et al. | 222/390 X |
| 3,913,799 | 10/1975 | Davis, Jr. | 222/390 X |
| 3,997,084 | 12/1976 | Davis, Jr. | 222/390 X |

*Primary Examiner*—Allen N. Knowles

*Attorney, Agent, or Firm*—Cushman, Darby & Cushman

[57] ABSTRACT

A rotary power hand tool with a rotary chuck is mated to a push-in piston-type dispensing container of caulking via an adapter which mounts on the tool and is secured to the chuck. The adapter has a plunger provided on the end of a non-rotating screw. When the tool trigger is actuated, a transmission on the actuator is operated to advance the screw and plunger thus advancing the piston of the dispensing container. In the preferred embodiment a peg secured to the drive screw and protruding out of the adapter doubles as a way of preventing the drive screw from rotating and as a way to indicate the relative amount of contents remaining to be dispensed until the container is effectively empty.

10 Claims, 5 Drawing Figures

POWERED DISPENSER FOR CAULKING CARTRIDGE CONTENTS

BACKGROUND OF THE INVENTION

Cartridges of what is generically referred to as "caulking" are ubiquitous in our culture, particularly in the construction trade and in the home repair and restoration avocations. The contained product is generally a thick plastic material which may be squeezed or expelled from the cartridge at one end through a tubular dispenser tip, by pushing in a piston on the opposite end. Beside what more technically would be called caulking, such cartridges are used to contain and dispense various glues, adhesives, settable or curable plastic resin compositions and the like, all in pure form or as compounded with usual binders, extenders, preservatives, thickening agents, solvents, plasticizers, colorants, masking agents, dispersants and the like. Other products such as cake frosting, art and craft supplies and the like are or may be similarly contained and dispensed. "Caulking" as used herein is meant to refer to any and all of these products, and "viscous plastic material" is used as an equally generic synonym.

One way such cartridges are used is as replaceable mates for the familiar receivers which have trigger-actuated ratchet-advanced plungers which abut the cartridges' pistons and push them forwards. These are referred to herein as cartridges or containers of the "push-in piston type".

Another way such cartridges are used is to provide the rear end of the cartridge body with its own twistable actuator, connected via a lead screw which sealingly projects through a cartridge rear end wall, with a non-rotating piston within the cartridge. When the actuator is twisted the lead screw turns and advances the piston. Such a container is shown and described in my earlier U.S. Pat. No. 4,144,988, issued Mar. 20, 1979.

In my copending U.S. patent application Ser. No. 15,304 filed Feb. 26, 1979, I have shown and described a dispenser actuating chuck adapter for mating twistable actuator-provided dispensing containers, e.g. of the type shown and described in my aforesaid earlier U.S. Pat. No. 4,144,988, with a rotary power hand tool, e.g. an electric drill.

I continue to believe the rotary chuck adapter as described in my aforesaid copending U.S. patent application is very useful. However, in the form that product has heretofore been provided, it was not suitable for adapting rotary power tools for dispensing cartridge of the first above-mentioned push-in piston-type cartridge. It is clear that such cartridges will continue to have a substantial portion of the market for caulking dispensers and that such users so far appear to have been deprived of a way to power-dispense caulking from push-in piston-type containers.

SUMMARY OF THE INVENTION

Accordingly, it is an object of the present invention to provide ways and means for power-dispensing caulking from push-in piston-type containers.

Further, it is an object of the invention to provide ways and means for mating a rotary power hand tool such as an electric or pneumatic power drill with a push-in piston-type dispensing container of caulking.

The principles of the invention will be further discussed with reference to the drawings wherein preferred embodiments are shown. The specifics illustrated in the drawings are intended to exemplify, rather than limit, aspects of the invention as defined in the claims.

BRIEF DESCRIPTION OF THE DRAWINGS

In the drawings

Whereas the embodiments shown in FIGS. 2 and 4 are for mating an inexpensive non-reversing electric drill with a push-in piston-type dispensing container of caulking.

DETAILED DESCRIPTION

Figure 1:
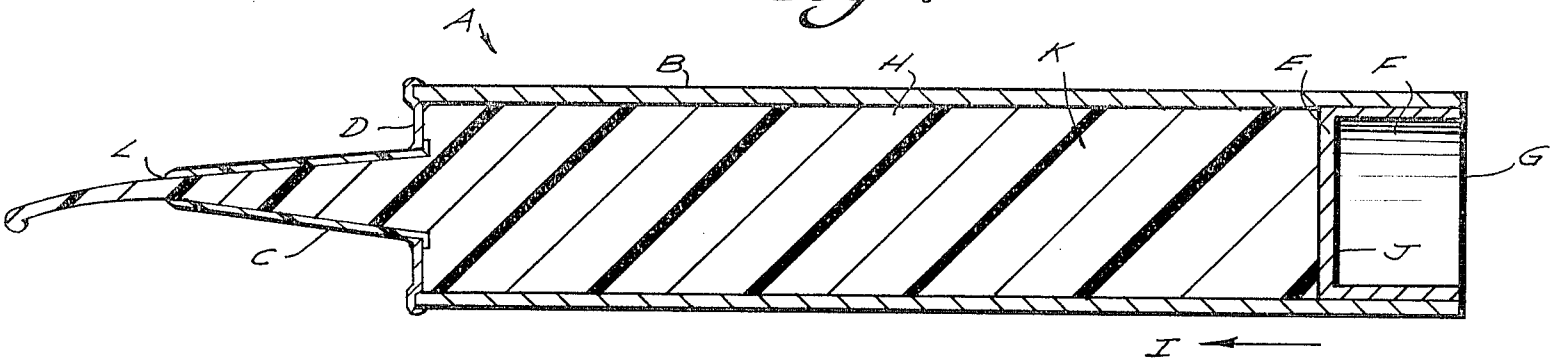
FIG. 1 is a generalized longitudinal sectional view of a typical push-in piston-type dispensing container of caulking.

In FIG. 1 there is shown in a generalized way a typical push-in piston-type dispensing container of caulking A. This is a tubular container having a tubular side wall B, having a tubular dispenser spout C provided in the forward end wall D and a piston E, sealingly but slidingly received in the bore F of the side wall B starting from the rear end G. Thus, the piston E forms the rear wall of the container A. A quantum of caulking H is contained within the bore F between the forward end wall D and the piston E. As the piston is pushed in, e.g. forwards in the direction of arrow I, by pushing on its exterior face J, the volume of the contained space K is decreased, pressurizing the caulking contents H and thus expressing an extruded bead of caulking out of the open tip L of the tubular dispenser spout C. A cap, not shown, may be used to plug the tip L before use of the container is begun. The plug may be of a replaceable type if it is possible the user will wish to reseal the tip L after only a fractional portion of the contents H have been dispensed from the container.

Figure 3:
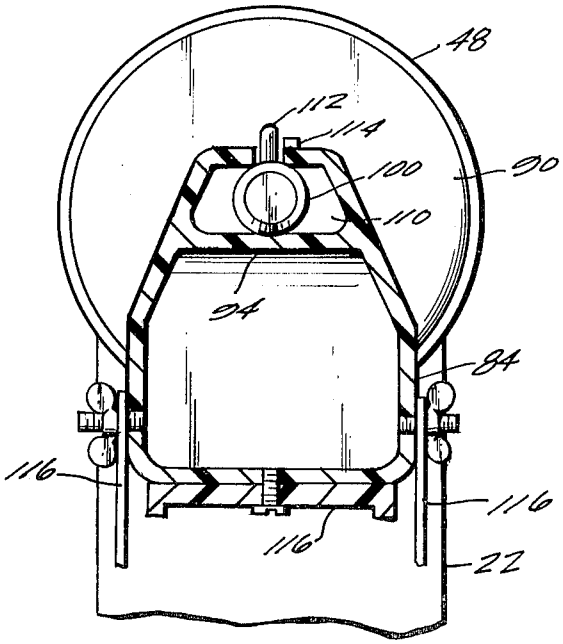
FIG. 3 is a fragmentary transverse cross-sectional view on line 3—3 of FIG. 2.
Figure 2:
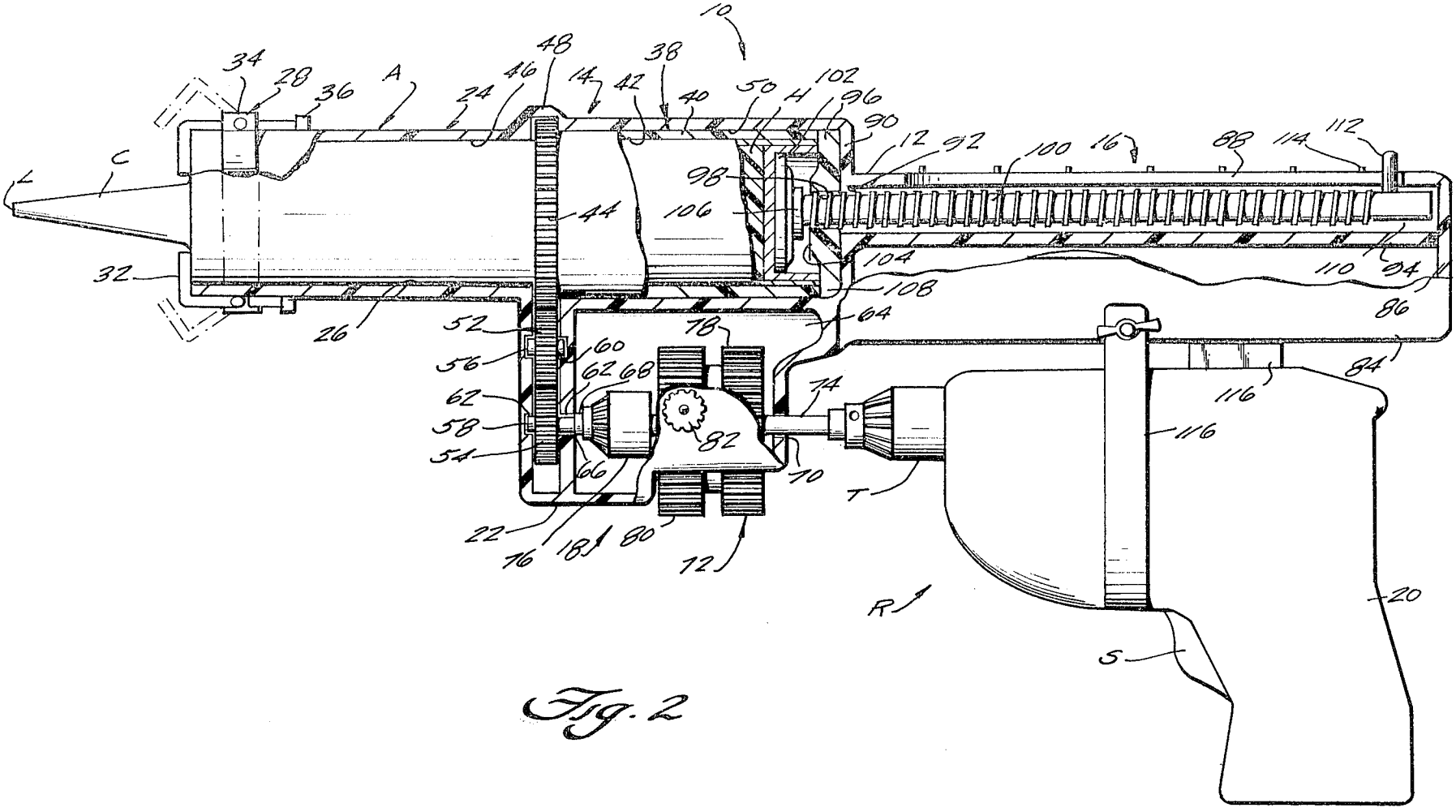
FIG. 2 is a longitudinal sectional view of a first embodiment of the apparatus of the present invention as mating a container of the FIG. 1 type with an electric drill.

Referring now to FIGS. 2 and 3, a push-in piston-type dispensing container of caulking A of the FIG. 1 type as just described hereinabove is depicted associated via an adapter 10 according to the present invention, with a rotary power hand tool such as an electric drill R, so that when the trigger S of the drill R is pressed, caulking H is dispensed out of the tip L.

The drill R is shown being of the plug-in electric motor-driven type, although it could just as well be of the self-contained battery-operated electric motor type or pneumatically or hydraulically motor operated. It may even be some other sort of power operated hand tool with a rotary chuck T such as a disk sander, router, or drain-cleaning tool or even one specially designed for the present purpose. Such tools will be generically referred to herein as a rotary power tool having a chuck for gripping a shaft to be rotated and a switch means for actuating the rotary power tool to rotate the chuck.

The adapter device 10 includes a body 12, for instance molded so two parts as a left half and a right half out of synthetic plastic polymer, then assembled together with other parts that are described hereinbelow, and secured together by any convenient means such as screws, adhesive, solvent welding or the like.

The body 12 has three major functional regions—a container receiving and container mounting region 14, a plunger and adapter mounting region 16 and a power transmission region 18. These regions, as shown overlap and interact somewhat, as illustrated.

Preferably, the device 10 is so configured that most of it extends along an axis that is longitudinally parallel to the chuck axis, but lies above the chuck T, with the power transmission region having portions in and bridging between the two parallel axes, that of the chuck T and that of the regions 14 and 16. This makes it easy for a user tp hold and use the device 10, supporting the assembly A/10/R with one hand at 20 and with another hand at 22.

The receiver 24 of the region 14 includes a tubular, forwardly opening chamber 26 sized and shaped to permit a standard container A to be slid backwards thereinto, so that only its spout C protrudes out of the front of the chamber 26. The receiver 24 further includes a means for fastening the received container A in place as shown. In this embodiment it takes the form of a removable forward end cap 28 which has a central opening outwards through which the spout C projects. The cap 28 is shown including a forward end wall 32 and a peripheral skirt 34 and with means 36 for removably securing the cap 28 in place at the forward end of the receiver chamber 26. In this instance the removable securement means is provided by a pair of toggle clamp arrangements a lot like those conventionally used to hold the one ends onto tank-type vacuum cleaner tanks. Other equivalent types of securements could be provided.

Within the rear half of the chamber 26 there is received and journalled for rotation coaxially with the receiver 24, a ring gear member 38 of the power transmission region 18.

The ring gear member 38 is shown including a tubular body 40 which has a longitudinal bore 42 that is internally sized to slidingly receive and fairly snuggly fit the rear half of the container A. (The term "half" is used colloquially here with no mathematical precision intended). At its forward end the tubular body 40 is coaxially provided exteriorly thereof with a ring gear 44 the axially short series of teeth of which projects radially outwards of the tubular body 40. Thus, the receiver chamber 24 includes a forward portion 46 of a first smaller diameter, an intermediate band 48 of larger diameter, and a rear portion 50 of somewhat smaller intermediate diameter. The bore 42 of the tubular body of the ring gear member is of about the same diameter as the forward portion 46 of the bore of the receiver 24.

The ring gear member 38 preferably also is molded of synthetic plastic resin and the enlarged band 48 of the receiver bore partially encloses the ring gear 44 to journal the ring gear member for rotation and to restrain the ring gear member against thrust. Preferably the plastics involved in making the members 38 and 12 are inherently lubricous relative to one another, and/or soap, grease or other lubrication may be provided. Directly below the ring gear 44 and serially meshed therewith, the body 12 is shown internally mounting a first pinion gear 52 and a second pinion gear 54. The gears 52 and 54 have respective stub axles 56 and 58 journalled in the body at 60, 62 for rotation about the respective axes. The gear 52 and its stub axle 56 may be molded of synthetic plastic resin as a single part; similarly the gear 54 may be integrally formed with the stub axle 58. The stub axle 56 of the second pinion 54 is shown projecting through its rear journal 62 into a cavity 64 of the body 12, via an opening 66 to provide a shaft 68 disposed within the cavity 64.

At its rear and axially in alignment with the first-described opening 66, the body cavity 12 is shown provided with a second opening 70.

A reverser mechanism is shown at 72. This may be of an off-the-shelf, presently commercially available item that is well known in the power drill art. Basically, it includes an input shaft 74, an output chuck 76 and an assembly of components 78 between its input and output ends, which may be manipulated, grasped, immobilized or turned, in order to switch between two modes of operation: a first mode in which the output chuck will rotate in the same angular sense that the input shaft is rotated and a second mode in which the output chuck will rotate in the angularly opposite sense that the input shaft is rotated. These devices 72 are widely sold in order to permit users of inexpensive, non-reversing power drills to upgrade their equipment so as to have a reversing capability at a lower cost than replacing their power drill with one that incorporates a reversing mechanism. Because such devices are widely known and commercially available the inner working of the device 72 will not be further described herein even though such a device may be used that is specially constructed for the present device 10, rather than commercially purchased. Suffice it to say that the reverser device 72 is partially or substantially received in the cavity 64 with its output chuck 76 receiving and being secured to the shaft 68 of the second pinion gear 54, and with its input shaft 74 projecting axially rearwards out of the cavity 64 and body 12 through the opening 70.

The mechanism components 78 are accessible for intermodal manipulation by being partially externally exposed as at 80 and/or by being indirectly manipulable via a suitable actuator means 82 mounted on the outside of the body 12 and protruding into the cavity 64.

Outside the body 12, to the rear of the cavity 64, the input shaft of the reverser is positioned to be removably received and mounted in the chuck T of the rotary power tool R for use.

It is the plunger and adapter mounting region 16 of the device 10 that remains to be described.

The plunger and adapter mounting region 16 of the body 12 is shown comprising a generally tubular side wall 84 with a closed rear end wall 86 and an upwardly opening slot 88 running substantially the length of the side wall 84 in the upper portion thereof. The front end wall of the body region 16 is part of the rear end wall 90 of the receiver 24 and has an opening 92 axially therethrough. A generally horizontal web 94 divides the interior space of the side wall 84 into two compartments, of which the upper one is laterally upwardly open via the slot 88 and includes the opening 92. The web 94 is a stiffener.

The device 10 further includes a plunger subassembly, comprising a plunger drive plate 96 in the form of a disk having an internally threaded opening 98 provided axially centrally therethrough. An externally threaded drive screw 100 is threadedly received in the opening 98 and has a disk-shaped plunger 102 mounted on the forward end thereof. This sub-assembly is shown including an annular boss 104 coaxially centrally formed on the forward face of the plunger drive plate 96, and an annular washer 106 received on the drive screw 100 axially between the plunger 102 and the plunger drive plate 96. The plunger drive plate 96, radially outwardly of the boss 104 includes a circumferentially extending outer peripheral region 108. In this latter region, the plunger drive plate 96 is abutted to the rear end of the ring gear member tubular body thus uniting these two elements into one by frictional contact only.

The drive screw 100 extends through the opening 92 and along within the upper compartment 110 and near the rear end thereof is provided with a peg 112 affixed thereto, which extends upwards and out of the slot 88. The purpose of the peg 112/slot 88 arrangement is twofold. First, this arrangement prevents the drive screw 100 from rotating relative to the body 12, yet permits the drive screw 100 to move axially relative to the body. Secondly, gradations 114 may be marked on the exterior of the body 12 beside the slot 88, whereupon the position of the peg 112 relative to the gradations 114 may be taken as an indication of the relative fullness-/emptiness of the container A, since the peg 112 will be positioned relatively rearwardly (as shown in FIG. 2) when the container A is full and will gradually move forwards as the container is emptied.

Elements 116 are provided for preferably removably securing the region 14 of the body 12, preferably at plural sites along its length, e.g. by straps, clips, clamps, adhesive, screws, hooks or a combination thereof; what is shown at 116 is typical.

In use, the device 10 is mounted on a rotary power tool R via elements 116 and the chuck T is tightened onto the shaft 76. A filled container A is placed in the receiver 24 with its open spout C protruding forwardly as shown. The container is secured in place, e.g. by securing the toggles as at 36. In this condition, if the reverser 72 is in its "forwards" mode and the trigger S is gripped, the rotating chuck T will, via transmission elements 72, 54, 52 and ring gear member 38 cause the plunger drive plate 96 to rotate. The latter, acting on the drive screw 100 which is constrained against rotation by the peg 112 will move essentially axially forwards. Accordingly the plunger 102 will press forwards on the piston E causing the piston E to slide forwards, pressurizing the viscous plastic contents H and expressing the contents in an extruded bead or ribbon out of the open tip L. Dispensing is continuous for so long as the trigger S is compressed, until the container is effectively emptied. Dispensing may be stopped before the container is empty, by releasing the trigger S. Usually in such an instance some contents H will continue to be expressed out of the tip L until pressure in the container is equalized; dispensing can be more rapidly terminated upon release of the trigger S if the user puts the transmission 72 in reverse and squeezes the trigger S again for a short time to back off the plunger 102 a little from the piston.

When the container A is effectively empty its piston E cannot be pushed further forwards. Then the clutch provided at 108/40 slips to prevent damage, and the user by noting the position of the peg and/or by noting that nothing more is coming out of the tip L will release the trigger S and realize that a new cartridge A is needed. Then, the trigger S may be depressed with the transmission 72 in reverse in order to back up the plunger 102 to its 102 position, whereupon the empty container A may be removed and a full one installed in its place.

Figure 4:
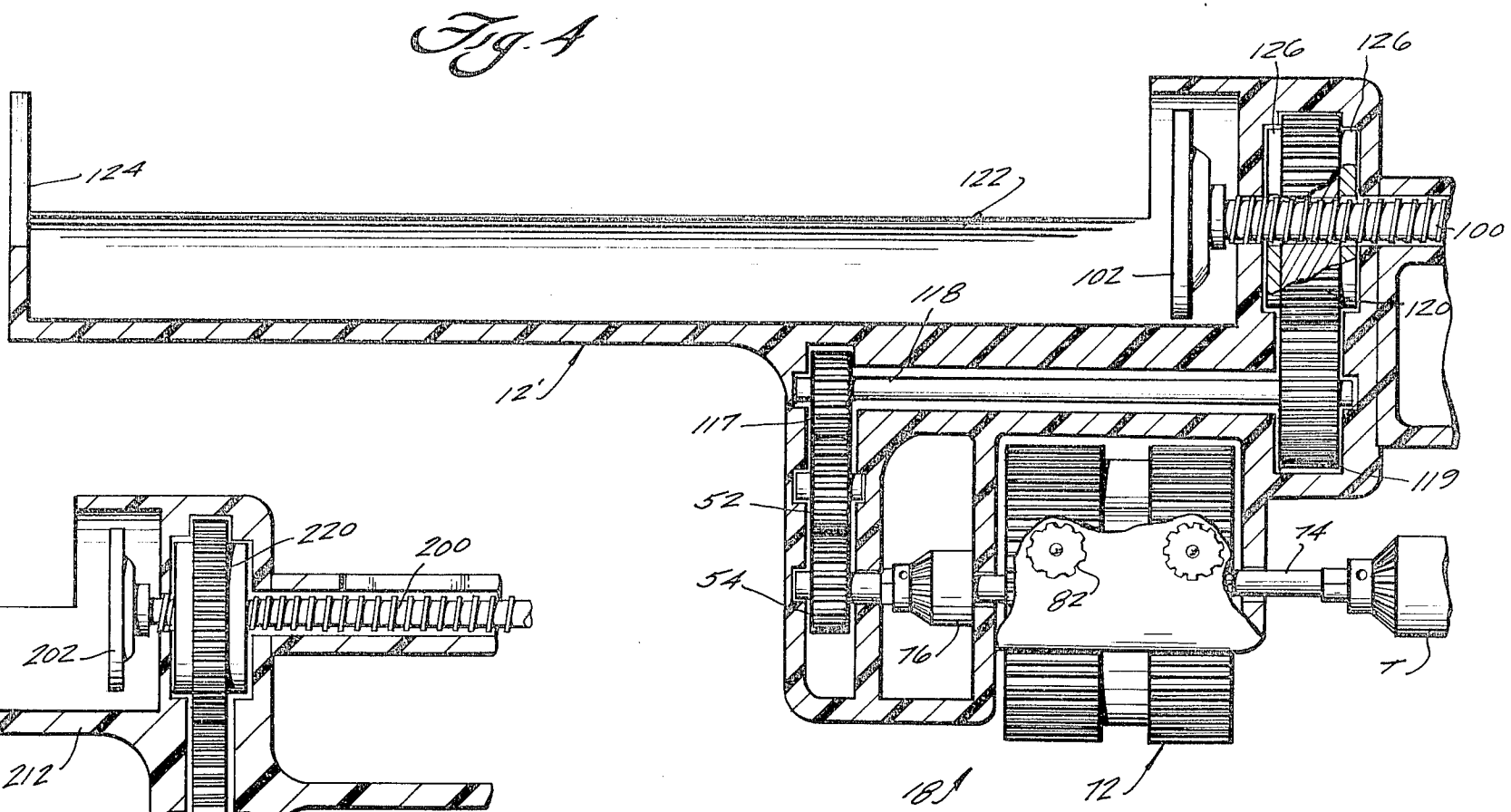
FIG. 4 is a similar but fragmentary longitudinal sectional view of a second embodiment.
Figure 5:
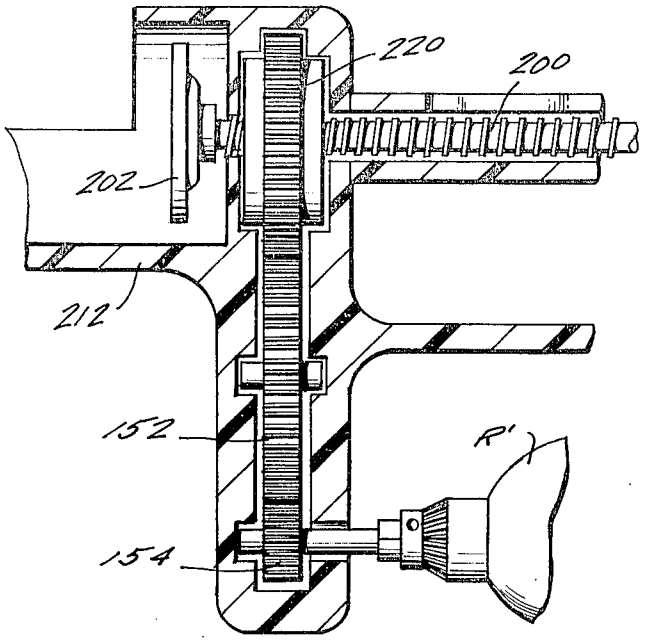
FIG. 5 shows in a fragmentary longitudinal sectional view similar to FIG. 4, but of a fourth embodiment for use in association with a rotary power tool which tool incorporates its own reversing mechanism so the adapter need not provide one.

Referring now to FIG. 4, a modification is shown. Like parts are given like numerals. What is changed is that the ring gear member 38 of the FIGS. 2 and 3 embodiment is replaced by transmission elements 117, 118 and 119 and the plunger drive plate 96 by transmission element 120, and the receiver 122 is of an open top type, with an integral, upwardly opening U-slotted forward end 124. Elements 117 and 119 are pinion gears mounted on a shaft 118. Element 120 is a pinion gear with an internally threaded bore by which it is mounted on the drive screw 100. Items 126 are washers serving as spacers and as bearings. The stub ends of the shaft 118 jounal the sub-assembly 117/118/119 for rotation about its axis in the body 12'.

The third embodiment is similar to the second excepting that, because the drill R' in this instance incorporates its own forward and reverse switchable transmission (a conventional provision on many such drills), the need for a separate reverser 72 is eliminated. Accordingly, the remaining corresponding transmission elements are correspondingly numbered, but raised by 100 and no further description is believed to be needed.

It should now be apparent that the powered dispenser for caulking cartridge contents as described hereinabove, possesses each of the attributes set forth in the specification under the heading "Summary of the Invention" hereinbefore. Because it can be modified to some extent without departing from the principles thereof as they have been outlined and explained in this specification, the present invention should be understood as encompassing all such modifications as are within the spirit and scope of the following claims.

What is claimed is:

1. For interposition between (a) a rotary power tool having a chuck for gripping a shaft to be rotated and a switch means for actuating the rotary power tool to rotate the chuck, and (b) a tubular container of viscous plastic material having a forward end wall with a tubular dispenser spout projecting forwardly therefrom, having a quantum of viscous plastic material contained therein, and having a piston sealingly slidingly received in the tubular container from the rear end thereof, which may be advanced by pushing forwardly thereon from the exterior of the rear face of said piston in order to extrude a bead of the viscous plastic material out of the tubular dispenser spout, (c) an adapter comprising:

a body having means for mounting said body on said rotary power tool;

a rotary power transmission means mounted on said body and having as an input end thereof a chuckable shaft for securement in said check of said rotary power tool;

a drive screw mounted for essentially axial movement on said body;

means between said body and said drive screw for preventing rotation of said drive screw;

means providing as an output end of said rotary power transmission means a threaded connection between said rotary power transmission means and said drive screw; and a plunger means mounted on said drive screw at the forward extent of said drive screw for abutting contact with said rear face of said piston of said container;

the rotary power transmission means including a tubular body having a ring gear externally provided thereon near the forward end of said tubular body and an annular plunger drive plate in driving engagement with the tubular body near the rear end thereof;

the plunger drive plate being internally threaded and threadably mounted on said drive screw as said output end of said rotary power transmission means; and the tubular body being journalled in the receiver for essentially rotary movement therein.

2. The adapter of claim 1, wherein:

said rotary power transmission means includes a reverser mechanism with means for switching between a forwards mode and a reverse mode, in which the transmission rotary output is, respectively, in the same angular sense as and in the opposite angular sense as the transmission rotary input.

3. The adapter of claim 1, wherein:

said means between said body and said drive screw for preventing rotation of said drive screw comprises laterally projecting peg means on said drive screw and a laterally opening slot on said body, out through which said peg projects.

4. The adapter of claim 3, further comprising:

a set of gradations provided exteriorly on said body beside said slot for indicating by juxtaposition with said peg the relative fullness of said container.

5. The adapter of claim 1, wherein:

said body includes a forwardly opening receiver for said container and means in said receiver for clamping said container in place with the dispenser spout thereof protruding forwardly out of the receiver.

6. The adapter of claim 1, wherein:

said ring gear is externally provided on said tubular body and said receiver partially envelopes said ring gear to prevent substantial axial movement of said tubular body.

7. The adapter of claim 1, wherein:

said annular plunger drive plate frictionally engages said tubular body to provide a clutch for permitting rotary slippage when the container piston cannot advance further.

8. The adapter of claim 1, wherein:

said body includes a laterally upwardly opening receiver with an integral upwardly opening U-slotted forward end wall for cradling said container.

9. In combination:

(a) a rotary power tool having a chuck for gripping a shaft to be rotated and a switch means for actuating the rotary power tool to rotate the check, and (b) a tubular container of viscous plastic material having a forward end wall with a tubular dispenser spout projecting forwardly therefrom, having a quantum of viscous plastic material contained therein, and having a piston sealingly received in the tubular container from the rear end thereof, which may be advanced by pushing forwardly thereon from the exterior of the rear face of said piston in order to extrude a bead of the viscous plastic material out of the tubular dispenser spout, (c) an adapter comprising:

a body having means for mounting said body on said rotary power tool;

a rotary power transmission means mounted on said body and having as an input end thereof a chuckable shaft for securement in said chuck of said rotary power tool;

a drive screw mounted for essentially axial movement on said body;

means between said body and said drive screw for preventing rotation of said drive screw;

means providing as an output end of said rotary power transmission means a threaded connection between said rotary power transmission means and said drive screw; and a plunger means mounted on said drive screw at the forward extent of said drive screw for abutting contact with said rear face of said piston of said container;

the rotary power transmission means including a tubular body having a ring gear externally provided thereon near the forward end of said tubular body and an annular plunger drive plate in driving engagement with the tubular body near the rear end thereof;

the plunger drive plate being internally threaded and threadably mounted on said drive screw as said output end of said rotary power transmission means; and the tubular body being journalled in the receiver for essentially rotary movement therein.

10. A power caulker outfit for dispensing caulking from a tubular container of viscous plastic material having a forward end wall with a tubular dispenser spout projecting forwardly therefrom, having a quantum of viscous plastic material contained therein, and having a piston sealingly slidingly received in the tubular container from the rear end thereof, which may be advanced by pushing forwardly thereon from the exterior of the rear face of said piston in order to extrude a bead of the viscous plastic material out of the tubular dispenser spout, said power caulker outfit, comprising:

a rotary power tool having a chuck for gripping a shaft to be rotated and a switch means for actuating the rotary power tool to rotate the chuck; and an adapter comprising:

a body having means for mounting said body on said rotary power tool;

a rotary power transmission means mounted on said body and having as an input end thereof a chuckable shaft for securement in said chuck of said rotary power tool;

a drive screw mounted for essentially axial movement on said body;

means between said body and said drive screw for preventing rotation of said drive screw;

means providing as an output end of said rotary power transmission means a threaded connection between said rotary power transmission means and said drive screw; and a plunger means mounted on said drive screw at the forward extent of said drive screw for abutting contact with said rear face of said piston of said container;

the rotary power transmission means including a tubular body having a ring gear externally provided thereon near the forward end of said tubular body and an annular plunger drive plate in driving engagement with the tubular body near the rear end thereof;

the plunger drive plate being internally threaded and threadably mounted on said drive screw as said output end of said rotary power transmission means; and the tubular body being journalled in the receiver for essentially rotary movement therein.

* * * * *